US010124923B1

(12) United States Patent
Soehnlen et al.

(10) Patent No.: US 10,124,923 B1
(45) Date of Patent: Nov. 13, 2018

(54) FLEXIBLE PRODUCT PACKAGE WITH PUSH-UP

(71) Applicant: CREATIVE EDGE DESIGN GROUP LTD., Canton, OH (US)

(72) Inventors: Gregory M. Soehnlen, North Canton, OH (US); Alexander Campana, Lorain, OH (US); Daniel P. Soehnlen, Canton, OH (US)

(73) Assignee: CREATIVE EDGE DESIGN GROUP LTD., Canton, OH (US)

( * ) Notice: Subject to any disclaimer, the term of this patent is extended or adjusted under 35 U.S.C. 154(b) by 56 days.

(21) Appl. No.: 15/355,755

(22) Filed: Nov. 18, 2016

Related U.S. Application Data

(60) Provisional application No. 62/257,310, filed on Nov. 19, 2015.

(51) Int. Cl.

| | |
|---|---|
| ***B65D 1/32*** | (2006.01) |
| ***B65D 1/42*** | (2006.01) |
| ***B65D 85/00*** | (2006.01) |
| ***B65D 43/02*** | (2006.01) |

(52) U.S. Cl.
CPC ..... *B65D 1/32* (2013.01); *B65D 1/42* (2013.01); *B65D 43/0202* (2013.01); *B65D 85/70* (2013.01)

(58) Field of Classification Search
CPC ... B65D 1/42; B65D 2543/00296; B65D 1/32
USPC ..... 220/669
See application file for complete search history.

(56) References Cited

U.S. PATENT DOCUMENTS

| | | | | |
|---|---|---|---|---|
| 2008/0023472 | A1* | 1/2008 | Brandt | B65D 75/24 220/4.23 |
| 2010/0170905 | A1* | 7/2010 | Ingman | A23G 9/045 220/521 |
| 2010/0314400 | A1* | 12/2010 | Kanda | C30B 15/10 220/669 |
| 2012/0058218 | A1* | 3/2012 | Blondeau | A23G 9/503 426/2 |

* cited by examiner

*Primary Examiner* — Shawn M Braden
(74) *Attorney, Agent, or Firm* — Fay Sharpe LLP

(57) ABSTRACT

A flexible package for an associated food item is disclosed. The package includes a wall forming an inner cavity and having a first, closed end a second, open end. The wall includes first and second sidewall portions and a flexible interconnecting third sidewall portion. A support rib extends into the cavity and is dimensioned to support the associated food item in the cavity in spaced relation with the wall. By pressing inwardly on the sidewall portions, the food item is advanced outwardly through the open end of the package.

11 Claims, 1 Drawing Sheet

FLEXIBLE PRODUCT PACKAGE WITH PUSH-UP

This application claims the priority benefit of U.S. provisional application Ser. No. 62/257,310, filed Nov. 19, 2015, the entire disclosure of which is expressly incorporated herein by reference.

BACKGROUND

The present disclosure relates to packaging, and more particularly to a food product package.

More specifically, the package is flexible and allows a product stored therein to be selectively pushed up to a top of the package. Selected aspects may find use in related applications.

It is known to provide a package for a food product. Typically, the package is designed to protect the product during shipping and handling. Consequently, designers focus on encompassing the food product and assuring that the product is protected from damage during shipping. Likewise, other features are to ensure that the food product remains sealed from the external environment until such time as the user desires to open the package for consuming the food product.

A need exists for an improved package or container that maintains protection for the food product, seals the product for freshness, and has sufficient flexibility to selectively advance or push the product from the container, and particularly to push the product from the container with one hand.

SUMMARY

A flexible package for an associated food item includes a wall forming an inner cavity and having a first, closed end and a second, open end. The wall includes first and second sidewall portions and a flexible region interconnecting the first and second sidewall portions. A support rib extends into the cavity and is dimensioned to support the associated food item in the cavity in spaced relation with the wall.

The support rib bisects the cavity between the first and second sidewall portions.

The closed end has an arcuate conformation.

The support rib is substantially U-shaped.

The first and second sidewall portions are substantially parallel to the support rib.

The package is made of at least one of low density polyethylene, high density polyethylene, and polystyrene.

The first and second sidewall portions taper away from one another as the first and second sidewall portions proceed from the closed end to the open end.

The support rib tapers outwardly adjacent the open end.

The first and second sidewall portions are substantially parallel to one another.

The wall further includes third and fourth sidewall portions that are interposed between the first and second sidewall portions.

The third and fourth sidewall portions each include a generally V-shaped recess.

Benefits and advantages of the present disclosure will become more apparent from reading and understanding the following detailed description.

DETAILED DESCRIPTION

Figure 1:
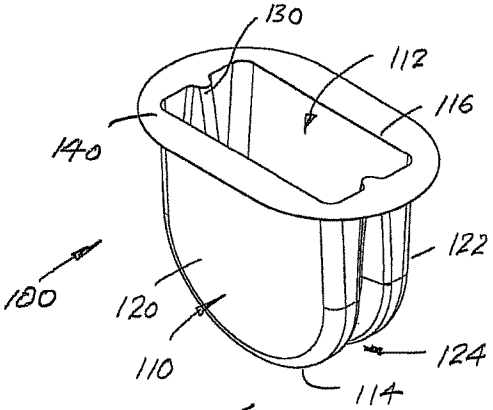
FIG. 1 is a perspective view of the flexible package.

Turning to FIGS. 1-4, there is shown a flexible package or container 100 dimensioned for receiving an associated food item or food product F (FIG. 4) such as a donut, bagel, biscuit, muffin, bread slice, or a similarly sized (capable of being held in one hand) or similarly shaped (generally round or rectangular/square shape) frozen food product or the like. Of course the food item could be of another shape without departing from the scope and intent of the present disclosure. In one preferred arrangement, the package 100 is made from a sufficiently flexible material such as a low density polyethylene, polystyrene, and/or high density polyethylene. Of course the particular material of construction should not be deemed limiting with respect to the present disclosure although compatibility and industry acceptance as a material capable of being used with a food item is required.

The flexible package 100 includes a wall 110 that wraps around or is dimensioned to receive the food product F, forming an inner cavity 112 and having a first, closed end 114 and a second, open end 116. The wall 110 includes first and second sidewall portions 120, 122 and an interconnecting or third sidewall portion 124 that joins perimeter edges of the sidewall portions 120, 122 along the generally U-shape, i.e., joining the sidewall portions in a continuous generally U-shape from a first edge at the second, open end 116, through the bight portion of the U-shape, to a second edge at the second, open end. In the illustrations, it is evident that the first and second sidewall portions 120, 122 have a generally U-shape with a bight portion of the sidewall portions located at the first, closed end 114.

The third sidewall portion 124 interconnecting sidewall portions 120, 122 includes a support rib 130 extending inwardly into the cavity 112 and dimensioned to support the associated food item F in the cavity in spaced relation with a remainder of the third sidewall portion 124. Thus, the food item F is supported along a perimeter portion of the food item within the cavity 112 by the U-shaped support rib 130. Inner, substantially parallel surfaces (facing, substantially planar inner surfaces) of the sidewall portions 120, 122 also add support for the food item F received in the cavity 112.

Figure 2:
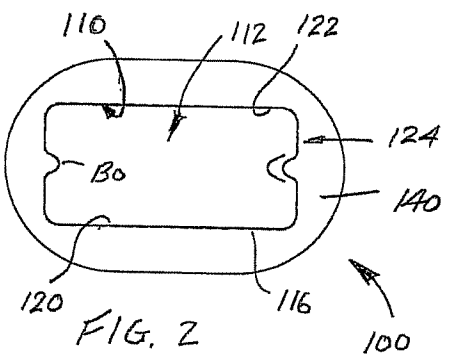
FIG. 2 is a top plan view of the flexible package.
Figure 4:
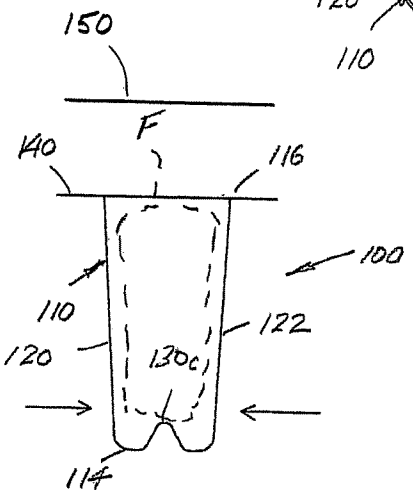
FIG. 4 is an end view of the flexible package.
Figure 3:
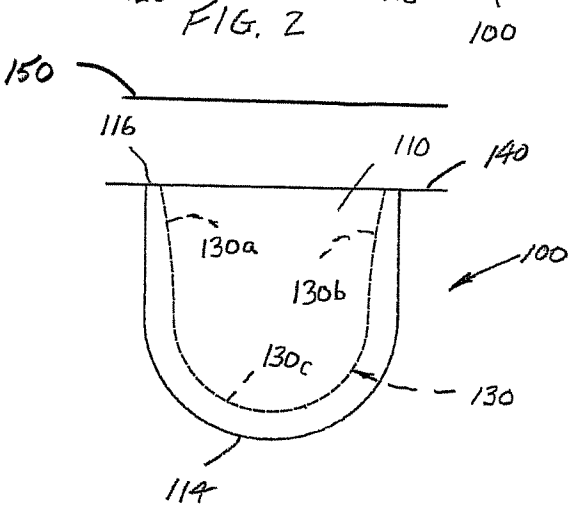
FIG. 3 is an elevational view of the flexible package.

As perhaps best illustrated in FIGS. 2 and 3, upper regions 130*a*, 130*b* of the support rib 130 diverge or taper outwardly relative to one another as the upper regions extend from a lower region 130*c*. Likewise, the sidewall portions 120, 122 diverge or taper outwardly (FIG. 4) relative to one another as the sidewall portions proceed from the lower end 114 toward the upper end 116. In this manner, an associated food item F (FIG. 4) is advanced upwardly and pushed outwardly from the lower end 114 through the opening at the second end 116 of the package 100 by pressing inwardly on the outer surfaces of the sidewall portions 120, 122 to urge the sidewall portions toward one another. If desired, the consumer can press on the outer surfaces of the sidewall portions 120, 122 near the bight portion of the U-shape of the sidewall portions and selectively advance the food item F upwardly and outwardly through the second, upper end 116 of the package 100. As the food item F is consumed, the consumer can continue to press on the outer surfaces of the sidewall portions 120, 122 at a location above the bight portion of the sidewall portions to continue to advance the food item F upwardly and outwardly through the second, upper end 116 of the package 100. This allows a user or consumer to consume the food item F above the open end

116 of the package 100, and as the food item continues to be consumed, the consumer presses inwardly on the sidewall portions 120, 122, bringing the sidewall portions closer together and continuing to push the food item F upwardly. The flexible nature of the material construction of the package 100 allows the consumer to easily manipulate the food item F, and advance the food item upwardly and outwardly from the package 100.

A generally planar surface 140 preferably extends outwardly, generally perpendicularly from the sidewall 110 of the package 100 at the upper end 116. The planar surface 140 circumscribes or is a continuous perimeter planar surface about the open, upper end 116 of the package 100. The planar surface 140 is adapted to receive, if desired, a removable cover or contact-seal material 150 that covers the upper end 116 of the package and hermetically seals the contents (e.g., food item F) of the package 100 from the outer environment. It is contemplated that the removable seal material 150 may be joined to the surface 140 of the package 100 with a re-sealable adhesive that may allow the cover to be selectively opened and selectively closed (re-sealed) to re-seal the food item F in the package, for example, if the consumer only eats a portion of the food item and desires to store the food item in the re-sealed package.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

It is claimed:

1. A flexible package for an associated food item comprising:

a wall forming an inner cavity and having a first, closed end and a second, open end;

the wall including first and second sidewall portions and a flexible region interconnecting the first and second sidewall portions such that the sidewall portions are selectively urged toward each other to reduce a size of the inner cavity, and a third sidewall portion that is interposed between the first and second sidewall portions; and a support rib extending from the third sidewall portion into the cavity and dimensioned to support the associated food item in the cavity in spaced relation with the wall, wherein the support rib tapers outwardly adjacent the open end, and the third sidewall portion does not taper outwardly adjacent the open end.

2. The flexible package of claim 1 wherein the support rib bisects the cavity between the first and second sidewall portions.

3. The flexible package of claim 1 wherein the closed end has an arcuate conformation.

4. The flexible package of claim 1 wherein the support rib is substantially U-shaped.

5. The flexible package of claim 4 wherein the first and second sidewall portions are substantially parallel to the support rib.

6. The flexible package of claim 1 wherein the first and second sidewall portions are substantially parallel to the support rib.

7. The flexible package of claim 1 wherein the package is made of at least one of low density polyethylene, high density polyethylene, and polystyrene.

8. The flexible package of claim 1 wherein the first and second sidewall portions taper away from one another as the first and second sidewall portions proceed from the closed end to the open end.

9. The flexible package of claim 1 wherein the first and second sidewall portions are substantially parallel to one another.

10. The flexible package of claim 9 wherein the third sidewall portions includes a generally V-shaped recess.

11. The flexible package of claim 1 further comprising a re-sealable material that covers the open end of the cavity and is secured via a re-sealable adhesive to a planar surface surrounding terminal ends of the first, second, and third sidewall portions and the rib at the open end.

* * * * *